United States Patent [19]

Bennett

[11] 3,948,412

[45] Apr. 6, 1976

[54] INSULATION OF STEEL TANKS

[75] Inventor: Robert B. Bennett, Freeland, Mich.

[73] Assignee: The Dow Chemical Company, Midland, Mich.

[22] Filed: May 16, 1975

[21] Appl. No.: 578,066

[52] U.S. Cl. ..... 220/9 A; 52/249; 52/410; 220/9 F; 220/15; 220/63 R

[51] Int. Cl.[2]... B65D 25/34; E04B 3/32; E04B 3/35

[58] Field of Search..... 220/9 A, 9 F, 9 LG, 10, 220/15, 63 R; 52/245, 247, 249, 268, 410, 461

[56] References Cited

UNITED STATES PATENTS

| | | | |
|---|---|---|---|
| 1,580,413 | 4/1926 | Cover | 220/9 A |
| 1,864,606 | 6/1932 | McBride | 220/9 A |
| 2,295,103 | 9/1942 | Friedly | 220/9 A |
| 2,576,698 | 11/1951 | Russum | 52/249 X |
| 2,691,458 | 10/1954 | Dinwiddie | 220/9 A |
| 2,731,374 | 1/1956 | De Reus | 220/9 A X |
| 2,928,565 | 3/1960 | Glasoe, Jr. | 220/9 A |
| 3,054,523 | 9/1962 | Batzer et al. | 220/1 D |
| 3,670,917 | 6/1972 | Nishimaki et al. | 220/9 F X |
| 3,855,811 | 12/1974 | Sauerbrunn et al. | 220/9 F X |
| 3,878,658 | 4/1975 | Davis et al. | 220/15 X |

FOREIGN PATENTS OR APPLICATIONS

| | | | |
|---|---|---|---|
| 885,722 | 12/1961 | United Kingdom | 52/410 |

*Primary Examiner*—William Price
*Assistant Examiner*—Stephen Marcus
*Attorney, Agent, or Firm*—Robert B. Ingraham

[57] ABSTRACT

Steel tanks are insulated by employing a plurality of material face foam plastic panels. Foam plastic panels have beveled edges and a number of slots formed in the panels. The panels are affixed to the tank by a plurality of studs welded to the tank.

8 Claims, 6 Drawing Figures

INSULATION OF STEEL TANKS

In many instances, it is desirable to provide thermal insulation for steel tanks which are employed as storage vessels for liquids which may become viscous at lower ambient temperatures. Oftentimes, it is desirable to maintain liquids, for example, residual oils at temperatures above ambient temperatures. Therefore, thermal insulating material is disposed about such tanks in order to maintain contents at the desired temperature. A wide variety of insulating materials have been used for such applications: various asbestos compositions in the form of preformed slabs or as a hardenable cementitious composition. Various foam plastics have been employed generally in the form of planks or panels, such planks or panels have been affixed to the tanks by a variety of retaining means including: bands, strips, studs, and the like. Generally, such panels or planks are covered with a protective layer to prevent mechanical damage to the foam plastic insulation and prevent decomposition of the foam by ultraviolet radiation. Substantial difficulty has been encountered in the use of foam plastic insulation. On generally cylindrical tanks, one of the more serious drawbacks is removal of part of the insulation by a windstorm. Frequently, on the lee side of a tank, substantial portions of the insulation will be removed when a tank is exposed to a severe windstorm. Oftentimes, the insulation of a steel tank requires a substantial amount of hand labor and results in an insulated tank having less than desirable characteristics. When the insulation of an insulated tank is subjected to substantial temperature variations, such as are encountered on a sunny, summer day and sub-zero weather night, substantial movement of the insulation relative to the tank can occur and oftentimes a cracking or bulging of the insulation will occur. Usually, such thermally induced defects make the insulation particularly susceptible to wind damage. Oftentimes in such tank insulation, the protective layer or skin is rigidly bonded to provide a monolythic layer covering the insulation. In the event of wind damage to a tank insulated in such a manner, the damage is rarely minor. Usually when such insulation fails and is removed due to the source of wind, the insulation has a tendency to peel away in a manner somewhat similar to the skin of a banana.

It would be desirable if there were available an improved insulation for steel tanks.

It would also be desirable if there were available an improved tank insulation for steel tanks which is not readily damaged by wind.

It would also be desirable if there were available an improved steel tank insulation which was readily installed with minimal labor.

It would also be desirable if there were available an improved tank insulation which offered improved resistance to thermal cycling.

These benefits and other advantages in accordance with the present invention are achieved in an improved storage vessel facility, the storage vessel facility comprising a steel tank of generally cylindrical configuration, the tank having a generally cylindrical side wall and a generally conical roof, a plurality of thermal insulating panels disposed at least on the roof, a majority of the panels having a generally rectangular configuration, the panels comprising at least a layer of foam plastic insulating material, the panels having first and second major faces and edges, the first major face of the panels having affixed thereto a weather resistant layer, the edges of the panels being beveled in such a manner that the first major face has dimensions greater than the second dimension face, the foam plastic material of the panel defining a plurality of slots, the slots extending inwardly into the panel from the second major face, the panels being affixed to an outer surface of the tank in a generally rectangular pattern by means of a plurality of studs and threaded retainers passing through the panels, the studs being generally peripherally disposed with respect to the panels.

Further features and advantages of the present invention will become more apparent from the following specification taken in connection with the drawing wherein:

FIG. 1 schematically depicts a view of the tank in accordance with the present invention;

Figure 1:
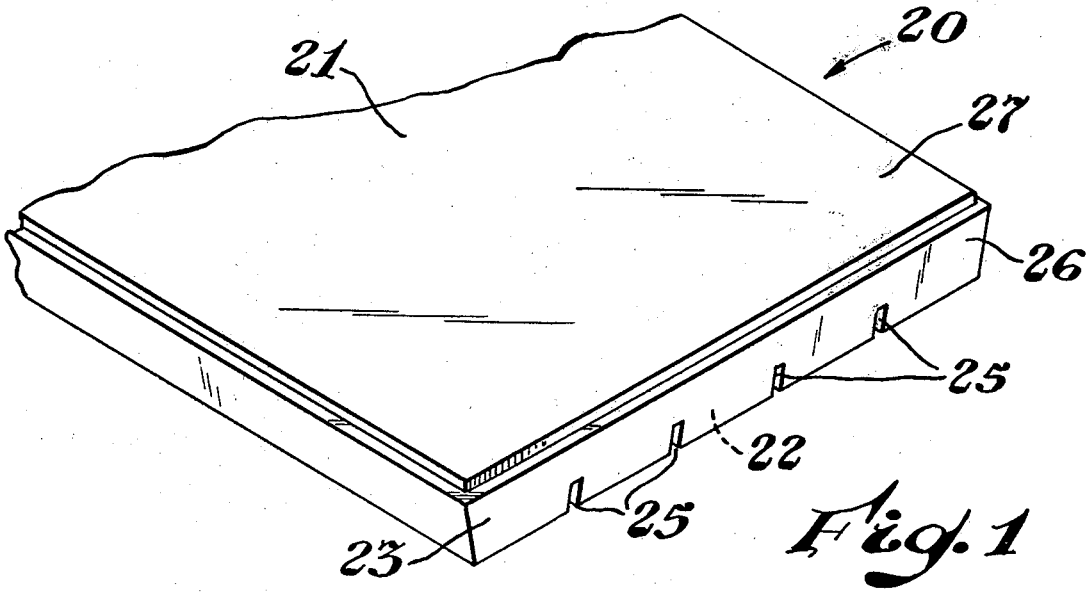

In FIG. 1 there is schematically designated a view of a tank in accordance with the present invention generally designated by the reference number 10, the tank 10 has a generally cylindrical configuration a cylinderical side wall 11, a roof 12, the roof 12 has a generally upwardly projecting, generally conical configuration. The form of the roof is popularly known as a flat cone roof. A plurality of thermally insulating panels 14 are disposed about the cylinder tank wall 11. The panels 14 are arranged in rows and columns to form a rectangular "pattern." A plurality of thermally insulating panels 15 are disposed upon the roof 12, the panels 15 are also of generally rectangular arrangement and are grouped in four quadrants.

Figure 2:
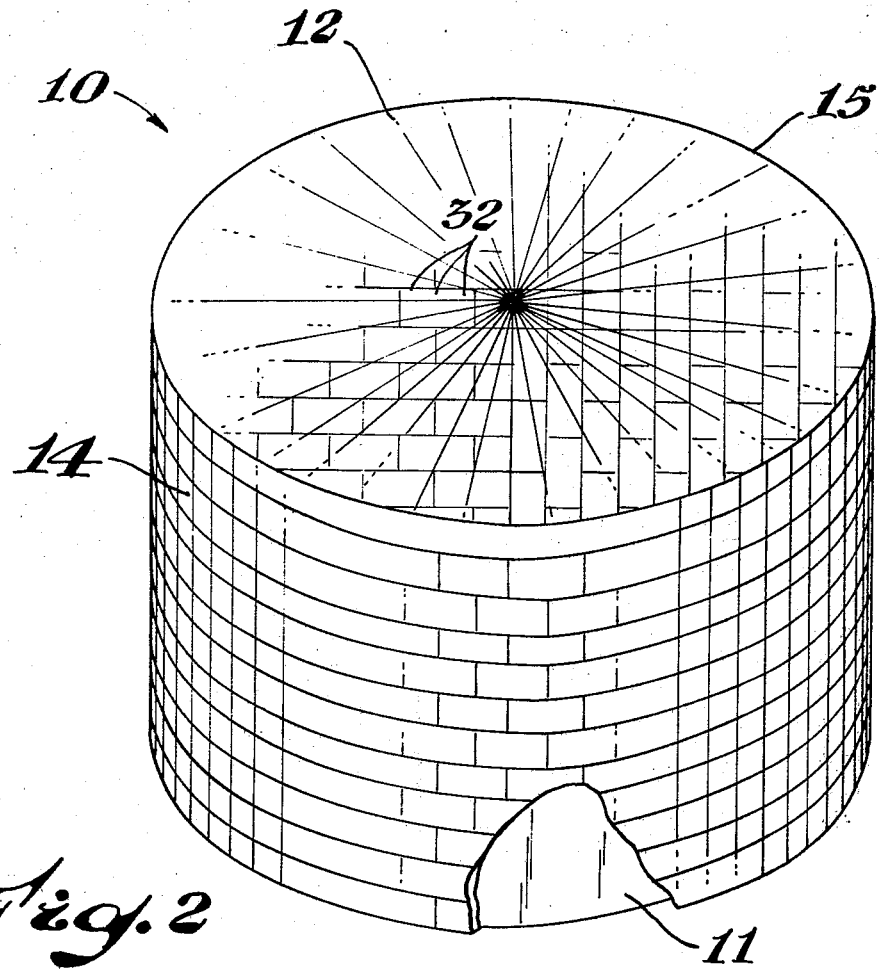
FIG. 2 is an end view of a panel used in the present invention.

In FIG. 2 there is depicted an end view of a panel generally designated by the reference numeral 20 which is similar to the panels 14 and 15 of FIG. 1. The panel 20 has a generally flat rectangular configuration, a first major face 21 and a second major face 22. The panel 20 defines a peripheral edge 23 extending about and joining the major faces 21 and 22. The edge 23 is beveled in such a manner that the major face 21 is larger than the major face 22. Beneficially, the bevel has an angle of about 5° to 30° from a plane normal to one of the major faces 21 or 22. Beneficially, the bevel is from about 15° to 25°. In general the thicker the panel, the smaller the angle. Larger angles are more desirable for thinner panels. The bevel is employed primarily as a means of providing a resilient edge portion to the panel to minimize thermal stresses. A plurality of slots 25 are defined in the panel 20. The slots 25 extend the entire length of the panel 20 and are disposed in a generally parallel relationship. The slots 25 extend from the second major face 22 inwardly toward the first major face 21. The panel 20 comprises a first or major portion 26 which is a slab of foamed plastic insulation such as polystyrene foam, polyurethane foam, epoxy resin foam, phenolic resin foam, and the like. Desirably for most applications, a closed cell foam is employed in order to minimize water retention. A water resistant layer 27 is affixed to the slab 26 equally adjacent the first major face 21. The weather resistant layer 27 advantageously is a metal sheet such as steel, aluminum, or the like with or without an organic coating such as a paint on the exposed side. In the event the insulation is being used in a particularly corrosive atmosphere, the weather resistant layer 27 may be glass fiber reinforced synthetic resinous material such as polyester resin or epoxy resin.

Figure 3:
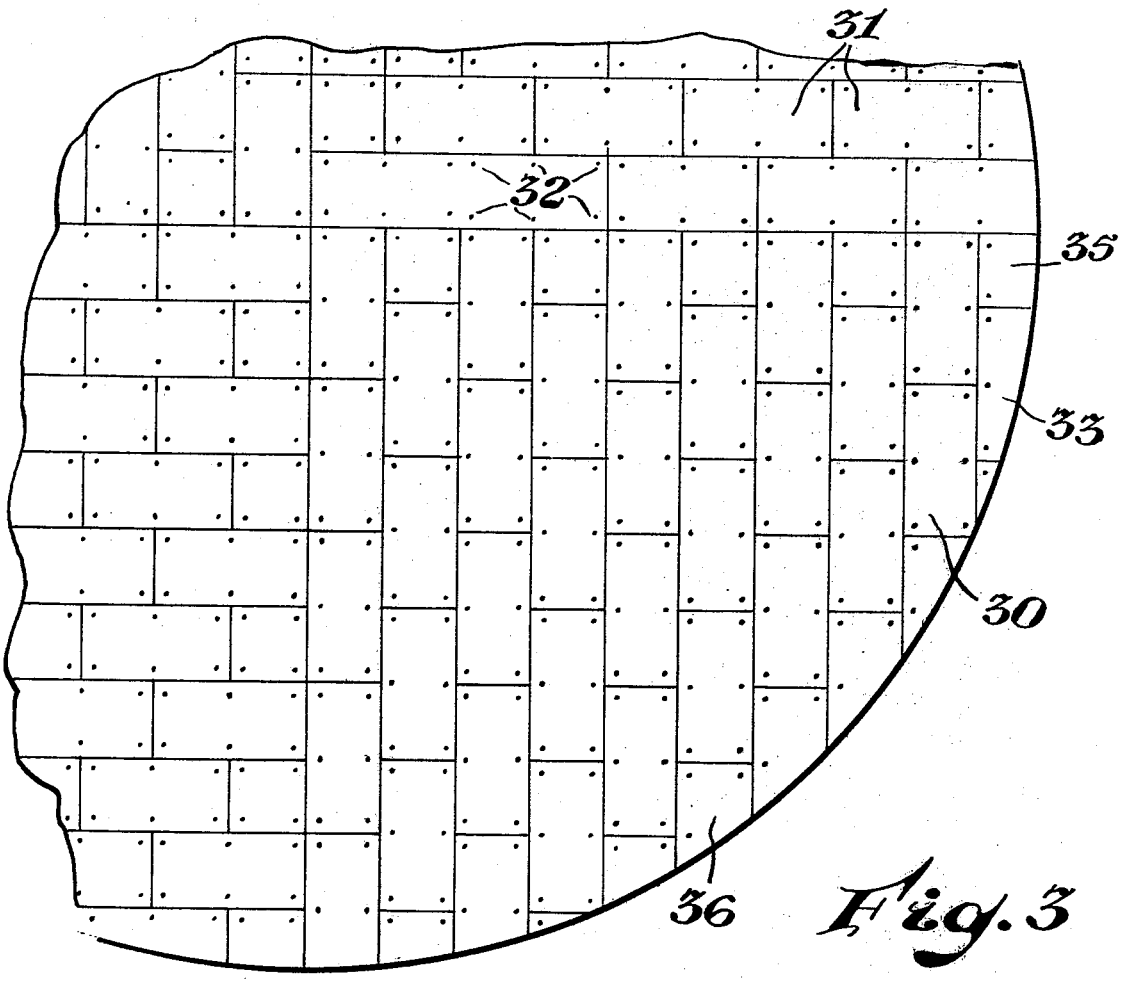
FIG. 3 is a schematic representation of an insulated tank roof.

In FIG. 3 there is shown a schematic fractional view of a flat cone tank roof generally designated by the reference numeral 30. The roof 30 has disposed thereon a plurality of panels 31, the panels 31 having generally rectangular configuration wherein the length of the panel is twice the width of the panel. The panels are disposed in a generally rectangular arrangement in four groups. The panels are peripherally fastened to the roof at a plurality of locations indicated by the reference numeral 32. The locations 32 are generally peripherally disposed relative to the panels 31 and are in each of the corners and generally in the middle of the two major sides. The roof 30 has an edge portion 33 which is insulated by fractional panels or panel portions such as portions 35 and 36.

Figure 4:
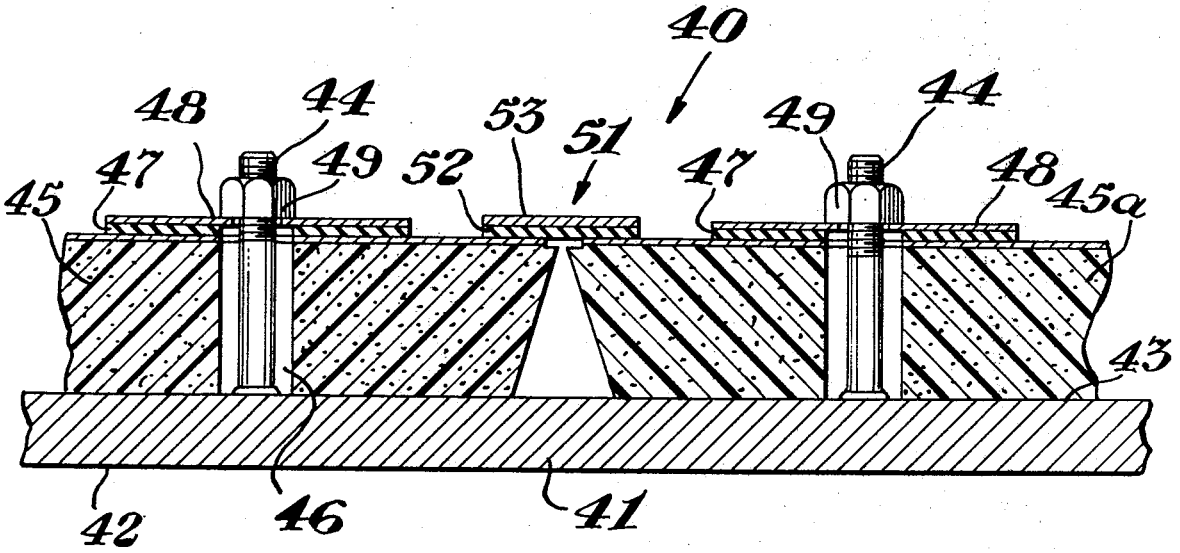
FIG. 4 is a schematic sectional representation of an insulated tank such as that of FIG. 1.

In FIG. 4 there is depicted a fractional sectional view of an insulated tank roof generally designated by the reference numeral 40. The insulated tank roof 40 combines a steel tank roof 41 having an internal side 42, an external side or face 43. A plurality of stainless steel studs 44 are welded to the external face 43 of the tank roof 41. The studs 44 project generally normally from the tank roof 41. A first insulating panel 45 is disposed on the face 43 of the tank roof 41, the panel 45 defines a passage 46 extending normally therethrough and receives the stud 44. A like panel 45A is disposed adjacent the panel 45 and similarly receives a stud 44. Disposed over the studs 44 adjacent the panels 45 and 45A and remote from the surface 43 is a first or resilient sealing means or washer 47. Beneficially, the washer 47 may be of rubber or resilient synthetic resinous thermoplastic material such as plasticized polyvinyl chloride, polyethylene and the like. Immediately adjacent the washers 47 is a rigid washer 48 beneficially of metal such as aluminum or steel or of a glass fiber reinforced thermoset plastic. A nut or retaining means 49 threadably engages the studs 44 and forces the washers 48 and 47 toward the external surface 43 of the tank roof 41. An edge sealing means 51 bridges adjacent edges of the panels 45 and 45A on an external surface of the panels remote from the tank 41. Beneficially the sealing means 51 comprises a pressure sensitive adhesive layer 52 such as butyl rubber, asphalt and the like and a support and protective layer 53 such as aluminum, steel, polytetrafluoroethylene and the like. The sealing means 51 is desirably applied as a prefabricated tape and provides a weather sealing between the edges of adjacent panels.

Figure 5:
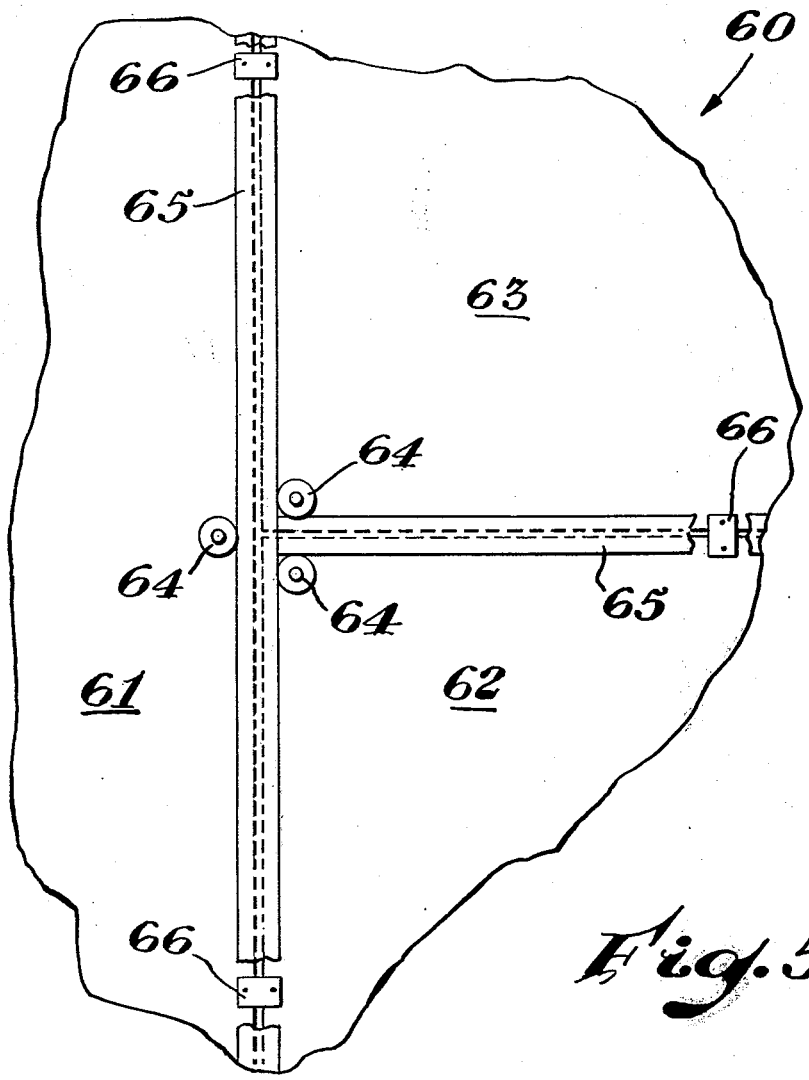
FIG. 5 is an enlarged fractional view of a portion of the tank roof of FIG. 3.

In FIG. 5 there is depicted a fractional external view of a tank roof generally designated by the reference numeral 60. The tank roof has disposed thereon the panels 61, 62 and 63. The panels are affixed to the tank proper by means of stud and washer assemblies 64 generally identical to those depicted in FIG. 4. A sealing or flashing tape 65 joins adjacent edges of the panels 61, 62, and 63. Retainer clips 66 are disposed generally midway between the assemblies 64.

Figure 6:
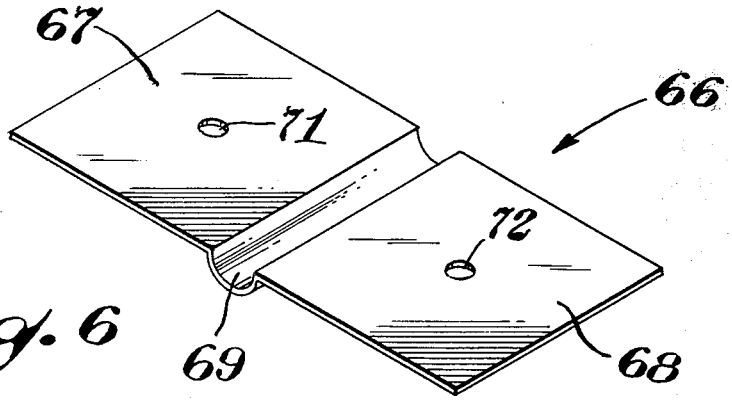
FIG. 6 is an enlarged view of a clip used in the assembly of FIG. 5.

FIG. 6 depicts a view of a retainer clip 66, the clip 66 has a generally planar configuration and has a first planar end 67 and a second planar end 68. Between the ends 67 and 68, the clip defines an arcuate generally cylindrical depression 69. The ends 67 and 68 define a fastener receiving opening for screw holes 71 and 72, respectively. The clips 66, when installed between adjacent edges of panels, permit movement of the panels with temperature change and serve to prevent bowing or distortion of adjacent panel edges away from each other and prevent undue stress on the sealing tape such as the tape 65 of FIG. 5.

Tanks insulated in accordance with the present invention provide several distinct advantages. Under extreme wind conditions, an individual panel may be removed or perhaps two or three individual panels. The panels are basically supported by the studs in each panel, the joints between adjacent panels are primarily a weather seal. Thus, under extreme wind conditions, one or more of the insulating panels may be removed without the tendency to tear large sections of the insulating material free from the surface of the tank. The beveled edges of the panels provide a dual function: (1) they permit flexure of the foam insulating material under thermal stress, and (2) the panel edges, in combination with the adjacent tank, provide a water drainage channel in the event that a leak should occur due to mechanical damage or failure of the continuity of the external tank surface. In the event of mechanical damage to the insulation on the structure, panels are readily replaced without significant effect on adjacent portions of insulation. The kerfs or grooves formed in the face of the panel which is disposed adjacent the tank surface also serve to significantly reduce the overall relative mechanical working as temperatures vary.

Tanks in accordance with the present invention are readily prepared with minimal labor and such labor need not have a high skill level.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

That which is claimed is:

1. In an improved storage vessel facility, the storage vessel facility comprising a steel tank of generally cylindrical configuration, the tank having a generally cylindrical side wall and a generally conical roof, a plurality of thermal insulating panels disposed at least on the roof, a majority of the panels having a generally rectangular configuration, the panels comprising at least a layer of foam plastic insulating material, the panels having first and second major faces and edges, the first major face of the panels having affixed thereto a weather resistant layer, the edges of the panels being beveled in such a manner that the first major face has dimensions greater than the second dimension face, the foam plastic material of the panel defining a plurality of slots, the slots extending inwardly into the panel from the second major face, the panels being affixed to an outer surface of the tank in a generally rectangular pattern by means of a plurality of studs and threaded retainers passing through the panels, the studs being generally peripherally disposed with respect to the panels.

2. The vessel of claim 1 wherein the foam plastic insulating material is a closed cell foam.

3. The vessel of claim 1 wherein the plastic insulating material is polyurethane foam.

4. The vessel of claim 1 including moisture sealing means disposed between the weather resistant layer of the panel and the threaded retainers.

5. The method of claim 1 wherein the weather resistant layer is sheet metal.

6. The vessel of claim 5 wherein the sheet metal is aluminum.

7. The vessel of claim 1 including the moisture sealing means disposed over the adjacent edges of the panels.

8. The vessel of claim 7 wherein the sealing means comprises a tape having disposed on one face thereof a pressure sensitive adhesive.

* * * * *